US009867486B2

(12) United States Patent
Scrimshaw et al.

(10) Patent No.: US 9,867,486 B2
(45) Date of Patent: Jan. 16, 2018

(54) PORTABLE CUSHIONED SUPPORT

(71) Applicant: Hairy Turtle Pty Ltd, Brighton (AU)

(72) Inventors: David Scrimshaw, Highett (AU); Rosslyn Ruwhiu, Highett (AU)

(73) Assignee: Hairy Turtle Pty Ltd, Parkdale (AU)

( * ) Notice: Subject to any disclaimer, the term of this patent is extended or adjusted under 35 U.S.C. 154(b) by 0 days.

(21) Appl. No.: 15/479,148

(22) Filed: Apr. 4, 2017

(65) Prior Publication Data

US 2017/0202378 A1 Jul. 20, 2017

Related U.S. Application Data

(63) Continuation of application No. PCT/AU2016/000194, filed on Jun. 7, 2016.

(30) Foreign Application Priority Data

Jun. 9, 2015 (AU) ..... 2015902144

(51) Int. Cl.
*A47C 20/00* (2006.01)
*A47G 9/10* (2006.01)
(Continued)

(52) U.S. Cl.
CPC ..... *A47G 9/1081* (2013.01); *A47C 7/383* (2013.01); *A47G 9/1027* (2013.01); *A47C 7/38* (2013.01);
(Continued)

(58) Field of Classification Search
CPC ..... A47G 9/1081; A47G 9/1027; A47G 2009/1018; A47G 9/1054; A47G 9/1072; A47C 7/383; A47C 16/00; A47C 7/38
See application file for complete search history.

(56) References Cited

U.S. PATENT DOCUMENTS 2,295,906 A * 9/1942 Lacour ..... A47G 9/10 310/68 D
2,719,577 A * 10/1955 Eyman ..... A47C 7/383 297/391
(Continued)

FOREIGN PATENT DOCUMENTS

CA 1271568 A 7/1990
GR 20130100508 A 4/2015
WO 2015026408 A1 2/2015

OTHER PUBLICATIONS

ISA Australian Patent Office, International Search Report Issued in Application No. PCT/AU2016/000194, dated Jul. 25, 2016, WIPO, 4 pages.
(Continued)

*Primary Examiner* — David E Sosnowski
*Assistant Examiner* — Morgan McClure
(74) *Attorney, Agent, or Firm* — McCoy Russell LLP

(57) ABSTRACT

A support comprising a first pillow having a first pillow body comprising a first arm and a second arm, a second pillow comprising a third arm and a fourth arm, the first and third arms being attached to a first joint, and the second and forth arms being attached to a second joint wherein the first and second pillows can be rotated about the joints and optionally the joints are extendable to allow the relative angle and separation of the pillows to be varied. The support provides a user with myriad options for positioning the pillows and supporting their upper body, particularly during long periods of sitting upright, such as during travel in an aircraft or bus.

19 Claims, 8 Drawing Sheets

(51) Int. Cl.
*A47C 7/38* (2006.01)
*A47C 16/00* (2006.01)

(52) U.S. Cl.
CPC ..... *A47C 16/00* (2013.01); *A47G 2009/1018* (2013.01)

(56) References Cited

U.S. PATENT DOCUMENTS 2,724,133 A * 11/1955 Sorrell ..... B63C 9/30 441/115
3,757,365 A * 9/1973 Kretchmer ..... A47G 9/10 5/636
D250,985 S * 2/1979 Armstrong ..... D21/493
4,735,151 A * 4/1988 Bisbing ..... A47B 1/04 108/63
4,738,488 A * 4/1988 Camelio ..... A47C 7/383 297/383
4,757,983 A * 7/1988 Ray ..... A61G 13/12 5/637
D318,203 S * 7/1991 Zaghini ..... 5/636
5,530,980 A * 7/1996 Sommerhalter, Jr. ..... A47C 20/021 5/624
5,572,757 A * 11/1996 O'Sullivan ..... A47C 7/46 297/284.5
5,611,601 A * 3/1997 Cowgur ..... A47C 7/383 297/393
5,702,153 A * 12/1997 Pliska ..... A47C 7/022 297/230.1
D388,648 S * 1/1998 Bates ..... 5/636
D434,936 S * 12/2000 May ..... D6/601
6,532,611 B1 * 3/2003 Day ..... A47C 7/383 5/636
6,578,218 B2 * 6/2003 Wassilefsky ..... A61G 7/0755 5/630
6,973,691 B1 * 12/2005 Cordova ..... A47C 7/383 248/118
D541,096 S * 4/2007 Georgescu ..... D6/601
D553,412 S * 10/2007 Cupo ..... D6/601
D565,188 S * 3/2008 Pulver ..... D24/188
7,464,423 B2 * 12/2008 Goodwin ..... A45C 9/00 5/640
7,788,751 B1 * 9/2010 Diemer ..... A47C 7/383 297/391
7,909,406 B2 * 3/2011 Samuelsen ..... A47C 7/383 297/392
7,975,336 B1 * 7/2011 Perry ..... A47C 20/027 5/636
8,234,733 B1 * 8/2012 Fuss ..... A47C 7/383 5/637
8,448,275 B1 * 5/2013 Leach ..... A47C 20/027 297/284.5
8,984,688 B1 * 3/2015 Ibrahim ..... A47G 9/10 5/632
D744,660 S * 12/2015 Pulver ..... D24/188
2003/0084513 A1 * 5/2003 Splane, Jr. ..... A47C 20/026 5/657
2003/0167571 A1 * 9/2003 Corbin ..... A47C 16/00 5/655.3
2004/0026979 A1 * 2/2004 Haddon ..... A47C 16/00 297/393
2007/0033737 A1 * 2/2007 Melton ..... A47C 7/383 5/640
2009/0283557 A1 * 11/2009 Maginness ..... A45F 3/04 224/153
2011/0113557 A1 * 5/2011 Aguilera ..... B60N 2/4879 5/640
2012/0012431 A1 1/2012 Hamilton
2012/0047656 A1 * 3/2012 Benton ..... A47C 7/383 5/640
2012/0222219 A1 * 9/2012 Pusca ..... A47C 7/383 5/655.3
2013/0106163 A1 * 5/2013 Purpura ..... B64D 11/06 297/403
2013/0232696 A1 * 9/2013 Halimi ..... A47C 16/00 5/640
2013/0312192 A1 * 11/2013 Lee ..... A47G 9/007 5/639
2014/0000036 A1 * 1/2014 Cohen ..... A47C 7/383 5/639
2014/0201918 A1 7/2014 Ordonez
2014/0224257 A1 * 8/2014 Abramson ..... A61F 5/566 128/848
2015/0020314 A1 * 1/2015 Garcia ..... B60N 2/4879 5/636
2016/0331126 A1 * 11/2016 Mills ..... A47C 7/383

OTHER PUBLICATIONS

ISA Australian Patent Office, Written Opinion Issued in Application No. PCT/AU2016/000194, dated Jul. 25, 2016, WIPO, 7 pages.

* cited by examiner

PORTABLE CUSHIONED SUPPORT

CROSS-REFERENCE TO RELATED APPLICATIONS

This application is a continuation application of PCT Application No. PCT/AU2016/000194, filed Jun. 7, 2016. PCT Application No. PCT/AU2016/000194 claims the benefit of priority from prior Australian Patent Application No. 2015902144, filed Jun. 9, 2015, the entire contents of each of which are hereby incorporated by reference for all purposes.

FIELD OF INVENTION

The present invention relates to the field of pillows or cushions.

In one form, the invention relates to a portable cushion for supporting for a user's head, neck, shoulders or upper body to enable comfortable resting or sleeping when the user is sitting in an upright or forward position.

It will be convenient to hereinafter describe the present invention in relation to a seated user who is travelling by air, road or rail however it should be appreciated that the present invention is not limited to that use only. The present invention also has a wide range of applications wherein the user is stationary. By way of example the present invention could be used in a medical application where a patient is required to sit still in a relatively forward upright position while a procedure is being carried out, or because they have a condition that makes lying down inadvisable.

It will be further convenient to hereinafter describe the present invention as a support considering that such support is cushioned or configured to provide comfortable surfaces to engage with the travelers head or other part of their body. The support is portable however it may also be removably attachable to a further supporting non-portable device or structure such as a seat.

BACKGROUND ART

It is to be appreciated that any discussion or documents, devices, acts or knowledge in this specification is included to explain the context of the present invention. Further, the discussion throughout this specification comes about due to the realization of the inventor or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Many travelers are required to sit upright for long periods of time. Due to seating arrangements and space constraints they are unable to lay horizontal or near horizontal to facilitate comfortable sleeping. Often this results in tiredness, pain and discomfort with negative affect on the traveler's health and wellbeing.

Similarly, the nature and environment of travel provides vibration, bumps, noise and other interruptions to rest or sleep that are not usually experienced in a resting or sleeping environment. In an effort to gain extra comfort, travelers typically use U shaped pillows or adjustable flaps built into an airline seat to support the head from falling left, right or to the rear. However these devices rely on the head and body to be oriented rearward, resting on the seat back and they will not stop the head from falling forwards.

In an attempt to find a comfortable position when seated an airline traveler may try leaning forward and bracing their head in their hands. This is not sustainable as the arms relax as the traveler falls asleep and the brace collapses. Similarly a traveler may rest their head on a stack of pillows or other makeshift support items on an outwardly folded tray table, however this position may not be particularly comfortable for a sustainable period. Some devices, such as the device described in U.S. patent application 2003/0167571 provides a support that rests upon a tray table extending from the back of an airline seat so that a traveler to sit in a relatively forward upright position. However these types of devices are often unsuitable in confined spaces, such as the economy section of an aircraft because they are large in volume and cumbersome. Furthermore, devices of the prior art that require support from the tray table fixed to the seat of a passenger in front typically move if the passenger in front moves. This tends to disturb the traveler using the support.

Sustaining a seated position for extended periods is not only uncomfortable but can cause neck injuries or soreness to the traveler. In particular, sleep or comfortable rest can be difficult to achieve in aircraft when a traveler is required to sit in a relatively upright position in an environment that is noisy, vibrating and punctuated by disturbances due to aircraft movement and the activities of passengers or crew.

Given the nature of upright and seated travel, travelers may also take sleeping pills or similar and such drugs may cause drowsiness or other side effects. In the case of an emergency these side effects may limit the traveler's ability to react appropriately to avoid injury or life threatening situations.

In addition, travelers often use miscellaneous aids such as headphones, ear plugs, eye masks and other items. Travellers often pack such aids into carry-on baggage that is stored in overhead lockers or under their seat making them inconvenient to access. Furthermore, the aids often become lost, disorganized or are simply inconvenient to carry.

SUMMARY OF INVENTION

An object of the present invention is to provide a device that improves sleep or rest in the seated position.

Another object of the present invention is to provide a means for improved sleep or rest for road, rail or air travelers.

It is an object of the embodiments described herein to overcome or alleviate at least one of the above noted drawbacks of related art or to at least provide a useful alternative to related art.

In a first aspect of embodiments described herein there is provided a support comprising:

- a first pillow comprising a first pillow body having a first arm and a second arm,
- a second pillow comprising a second pillow body having a third arm and a fourth arm, the first and third arms being attached to a first joint, and the second and fourth arms being attached to a second joint wherein the first and second pillows can be rotated about the joints.

The first pillow and second pillow may be discretely connected or integral at the joints but must be able to be rotated about the joints by bending (if integral), or by virtue of inclusion of a hinge or other rotatable mechanism. When the first pillow and second pillow are integral the first joint and the second joint may be, for example flex points wherein the degree of rotation around the joints can be adjusted and releasably locked using a locking mechanism.

Typically each of the first pillow and the second pillow has an internal surface and an external surface. The support has a first, fully 'closed' position in which the two internal surfaces are pressed together and are in contact over most of their surface area. The support also has a second fully 'open' position in which the two internal surfaces are not in contact. The support can be changed between the fully open and fully closed positions by rotation about the joints.

In use at least one of the external surfaces is in contact with the user's body, typically their face if they are at rest.

In one embodiment of the present invention the first pillow and second pillow are of complementary size and shape. In another embodiment of the present invention the first pillow and the second pillow are of different sizes or shapes. for example, one pillow could be conformed to fit within a recess in the other pillow.

The pillows may be made of any material suitable for bearing the weight of a person at rest, and subject to the user's personal preference with regard to pillow softness and density. In a particularly preferred embodiment the pillows are made of expanded polymeric foam, such as memory foam, expanded styrene beads of foam pieces. Alternatively the pillows may be inflatable. The pillow may be constructed of any number of materials. For example, the pillows may have relatively soft or low density material encapsulating a higher density material that is configured to give shape and structural support to the pillow.

One or both pillows may comprise a rigid structural support located internally or externally to the pillows. In a particularly preferred embodiment, the rigid structural support is internal to one or both pillows and is generally U-shaped with each end located adjacent one of the joints.

In a particularly preferred embodiment the first pillow and the second pillow are U-shaped but the pillow shapes may vary for purposes such as styling, additional comfort, or for better spreading of any load imparted to the pillows by the weight of a user.

In the second aspect of embodiments described herein there is provided a support comprising:

- a first pillow comprising a U-shaped pillow body having a first arm and a second arm,
- a second pillow comprising a U-shaped pillow body having a third arm and a fourth arm, the first and third arms being attached to a first joint, and the second and forth arms being attached to a second joint, wherein the first and second pillows can be rotated about the joints and configured to receive the front of user's neck between the first and second arms and the user's head can rest in a forward position on the first pillow body.

In this manner the user can rest their head in a forward position, the pillow comfortably resting the weight of the user's head without them being required to provide assistance with their arms, hands or any other part of their person.

The support can be adjusted to support the travelers head as it tilts to the left, right, rear or forward position or any position in between.

Pillows

The shape and configuration of the support can provide clear space for the traveler to breathe when head rests on the first pillow, their face being located in the U-shaped void defined by the pillows leaving the user's nose and mouth unobstructed.

As such, the support of the present invention has multiple modes of use some of which are describe and depicted herein. These modes are possible by virtue of the support enabling a user to better use the space available in and around their seat in order to find their most optimum comfort position. Travel pillows of the prior art doenot offer as many different options.

Harness

In another preferred embodiment, the support includes a harness. Typically the harness is in the form of a strap of adjustable length having ends adapted for removable attachment to the support. For example the adjustable strap may be attached by buckles or Velcro adjacent the joints.

It will be readily apparent to the relevantly skilled person that it would be optimum to have a seat configured for ready attachment to the pillows or the harness.

The harness may be used in several ways. For example, the harness may be used to retain the support around the user's seat back or neck so that it does not fall when the weight of the travelers head is lifted from the support. Alternatively, the harness may be used as a shoulder or neck strap for carrying the support when not in use and leaving the user's hands free for carrying luggage and for other tasks.

Joints—Rotation

The first joint and second joint may be integral with one or both pillows. Alternatively the joints may be removably attached to one or both pillows.

Preferably the joints are configured to allow the angle between the first pillow and second pillow to be adjusted and then releasably locked in a desired position. For example the support may include a releasable locking mechanism so that the degree of rotation of the first pillow and second pillow about the joint can be releasably maintained. The ability to lock the pillows into position is particularly useful for providing support to the user's head and body in a forward upright or rearward upright position when the user is seated.

In one embodiment the joint is rotatably adjusted using a ratchet mechanism or screw thread mechanism. In another embodiment the joint is spring loaded and self locking.

Joints—Extension

In a preferred embodiment each joint is extendable. In a particularly preferred embodiment each joint comprises a hinge with one, or two extendable leaves. For example, one or both leaves may be in slidable arrangement with a frame that can be extended from the leaf and then retracted relative to the leaf.

Each leaf and any associated frame may independently, be embedded within a pillow, or adjacent an external surface of a pillow. Preferably the frame, or frame in combination with the leaf is capable of providing structural strength to the support and is capable of bearing some of the load imparted on the pillows.

Preferably the joints are configured to allow the extension or retraction of the joint to be adjusted and then releasably locked in a desired position. For example the support may include a releasable spring loaded locking mechanism.

Thus in a third aspect of embodiments described herein there is provided a support comprising:

- a first pillow comprising generally U-shaped body portion having a first arm and a second arm,
- a second pillow comprising a generally U-shaped body portion having a third arm and a fourth arm, the first and third arms being attached to a first joint, and the second and forth arms being attached to a second joint, wherein the first joint and the second joint are extendable.

The extendable leaves allow the pillows to be moved apart, varying the distance between them at least in the vicinity of the joints. Thus the user has the ability to (i) vary the degree of rotation of the pillows around the joints, and (ii) vary the separation between the pillows in the vicinity of the joints. This provides a user with myriad options for positioning the pillows and supporting their upper body.

Storage

In another preferred embodiment the support is adapted to provide storage for example for the harness or a removable joint. For example a storage area may be provided as a recess in one or both pillows.

Alternatively the storage recess may be in the form of a pocket or other receptacle that is integral, or removably attached to the support. The storage recess typically includes a suitable closure such as a zipper or flap secured by Velcro.

Modes of Use

There are multiple modes of use of the support of the present invention which will be apparent from the description and drawings herein.

In a fourth aspect of embodiments described herein there is provided a method of using a support, the support comprising:

- a generally U-shaped first pillow having a first arm and a second arm extending from a first pillow body,
- a generally U-shaped second pillow having a third arm and a fourth arm extending from a second pillow body, the first and third arms being attached to an extendable first joint, and the second and forth arms being attached to an extendable second joint, wherein the method comprises the steps of:

(a) rotating the first and second pillows about the joints,
(b) optionally extending the first and second joints,
(c) locating the front of user's neck between the first arm and second arm so that a user's head can rest in a forward position on the first pillow body, and
(d) locating the second pillow on a surface to support the weight of the user's head.

The weight of the user's head resting in a forward position on the first pillow body can thus be dispersed to the second pillow and then onto the surface on which it rests, such as the user's shoulder, user's torso, horizontal surface such as a table top or chair arm, vertical surface such as a wall.

The method of use may further comprise the step of connecting a harness between the support and the user, or structure for bearing part of the load.

Other aspects and preferred forms are disclosed in the specification and/or defined in the appended claims, forming a part of the description of the invention.

In essence, embodiments of the present invention stem from the realization that a travel pillow can be configured to better support the weight of a user's head when they are confined in an upright sitting position for extended periods of time. The configuration of the travel pillow can be angled or extended to provide more options for the user to comfortably orient themselves in a forward sitting position within a limited space such as an airline seat.

Advantages provided by the support of the present invention comprises the following:

- ability to support the head, neck and first body in a relatively forward position when sitting;
- can be used in a multitude of travel applications in aircraft, trains, buses, cars, boats, in addition to other non-travel related applications such as sitting at an office desk, or during medical procedures where patients are required to have their body upright, or any other situation requiring an upright sitting position;
- is portable and can remain comfortably placed around the neck while a user is walking, such as between transit services, thus providing free hands to carry other items;
- may be attached to a secondary non-portable device or structure to provide additional support to the user;
- provides an additional and improved level of comfort and increases the user's likelihood of gaining sleep when compared to devices of the prior art designed for this said purpose;
- allows a user to make the best use possible of the space around them, even very confined space; by enabling them to bend forward, or to either side;
- may be worn by the traveler and therefore not considered to be carry-on or check-in luggage;
- provides all the advantages of a conventional U shape pillow of the prior art;
- can be used to carry, organize and store various accessory & travel related items.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

Embodiments disclosed herein provide a portable support for a user's head and neck which can be used in multiple modes.

In a particularly preferred mode, the user's head and neck are supported. This first mode of operation is not dissimilar to a conventional travel pillow whereby the traveler positions the support on the shoulders and around the neck.

In another preferred mode, the user's head, neck, shoulders and upper body are supported. This second mode of operation enables the user to open the two pillows of the support to an angle which provides a comfortable resting or sleeping position whereby the user's face, head, neck, shoulders and upper body are supported relatively forward of the upright seated position thus providing a comfortable position for sleep or rest.

Figure 1:
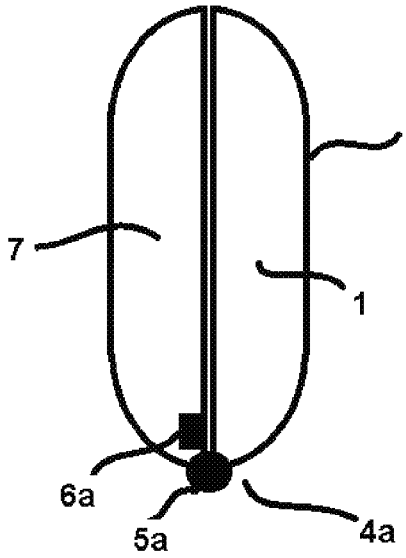
FIG. 1 illustrates an embodiment of the present invention in side view in a closed position.

FIG. 1 depicts a side view of one embodiment of the support 8 of the present invention suitable for portable use during travel. In this view the support 8 is in the closed position with the inner surface 1*a* & 7*a* of each pillow 1 & 7 in abutting relationship. The pillows 1 & 7 are connected by jointed hinges 4*a* & 4*b* which are tightened and locked by rotating either or both of the knobs 5*a* or 5*b*. In the closed position, the support 8 is compact and portable and readily stored or carried.

In this embodiment the first pillow 1 and second pillow 7 are of the same shape and dimensions. It can readily be seen that each pillow has a body and two arms. The end of each arm terminates at the hinge 4, thus connecting the two pillows 1 & 7.

Figure 2:
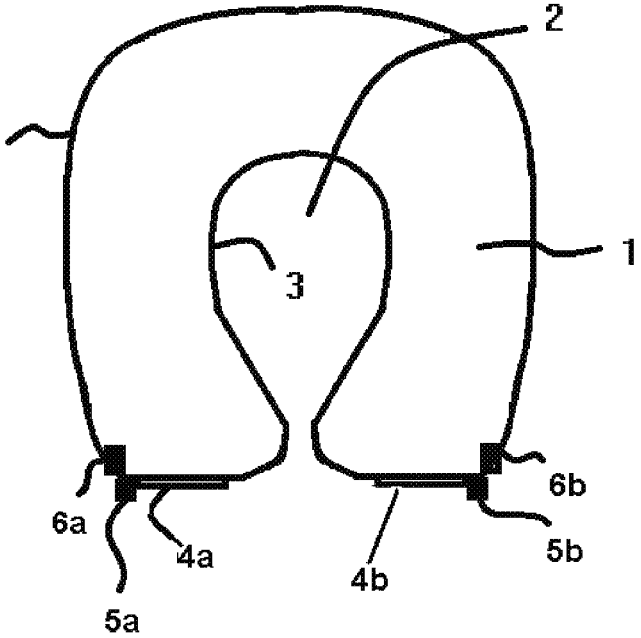
FIG. 2 illustrates the invention of FIG. 1 in front view.

FIG. 2 depicts the support 8 of FIG. 1 from the front. In this view the first pillow 1 can be readily seen, and obscures from view the second pillow 7 which is directly behind. The pillows 1 & 7 in this embodiment are generally U-shaped and define a space 2 for receiving a travelers face, head and neck. The hinges 4*a* & 4*b* are folded and locked so that in this view the support 8 is maintained in the closed position. Each hinge 4*a* & 4*b* has two leaves 10*a*, 10*b*, 10*c* & 10*d* (10*a* & 10*b* associated with the first pillow 1; 10*c* & 10*d* associated with the second pillow 7). Each of knobs 5*a* & 5*b* can be rotated in a first direction to lock the hinge to which they are respectively attached.

When the knobs 5*a* & 5*b* are rotated in a counter direction the restriction on their respective hinges 4*a* & 4*b* is reduced and the angle between the pillows 1 & 7 can be adjusted according to the desired support position of the traveler. In this embodiment the frames 9*a* & 9*b* can be extended from the leaves 10*a* & 10*b* of the joint hinges 4*a* & 4*b*.

The U-shape 3 formed by the pillows 1 & 7 allows the user to position the support 8 on their neck and wear the support 8 as they board or disembark from an aeroplane, train or bus or when they are in transit, as well as providing head and neck support while seated relatively upright.

Figures 3, 4:
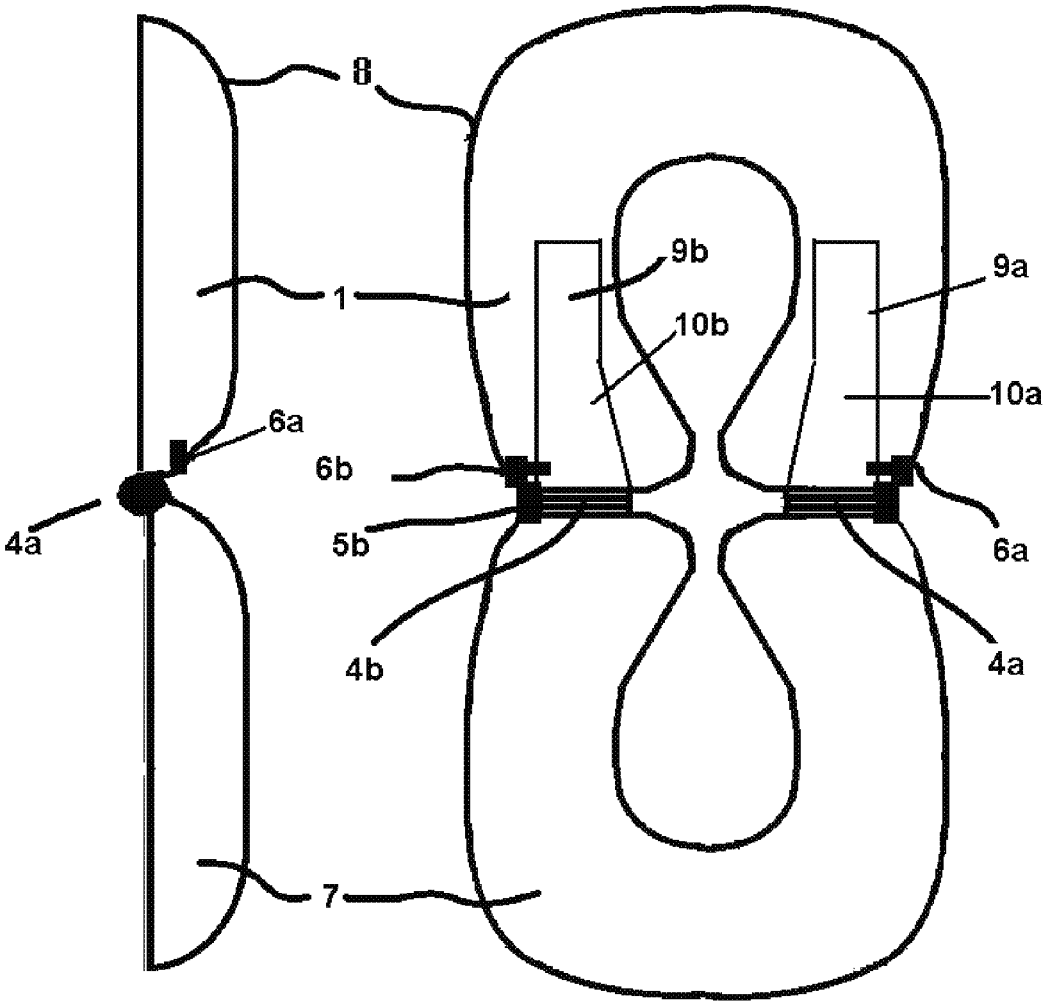
FIG. 3 illustrates the invention of FIG. 1 in side view in an open position.
FIG. 4 illustrates the invention of FIG. 1 in front view in an open position.

FIG. 3 is a side view of the support 8 in the open position. In this view the hinges of the joints 4 have been rotated, moving the pillows 1 & 7 to a 180 degree angle of separation at the joints 4*a* & 4*b* as compared with the closed position shown in FIG. 1. The hinges of the joints 4*a* & 4*b* have been adjusted by rotating their respective knobs 5*a* & 5*b* as described with reference to FIG. 2.

FIG. 4 is a front view of the support 8 as shown in FIG. 3. In this view the hinges of the joints 4*a* & 4*b* are both visible. Each joint hinge has a leaf 10*a* & 10*b*, each of which has an extendable frame 9*a* & 9*b* which in this view is shown adjacent an internal surface of the first pillow 1. The extendable frames 9*a* & 9*b* are inside the pillow and therefore cannot be seen. In other embodiments of the support however, other arrangements of the hinge leaves and extendable frames may be used, such as having all leaves and frames located inside the pillows, or all located on surfaces of the pillows, or a combination of the two. The buttons 6*a* & 6*b* are configured to engage with the leaves 10*a* & 10*b* to actuate extension or locking of the frames 9*a* & 9*b*. FIG. 4 depicts the frames 9*a* & 9*b* in the fully retracted position which brings the pillows 1 & 7 together in abutting relationship and the ends of their arms.

Figure 5:
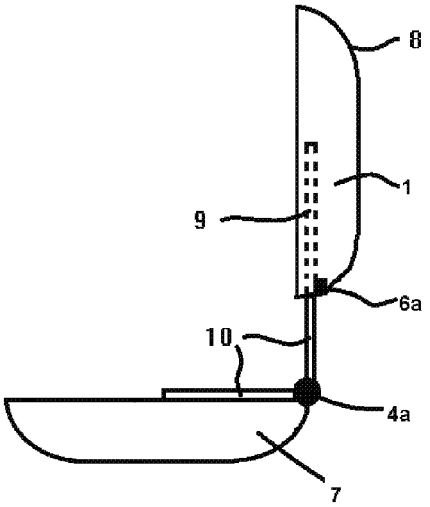
FIG. 5 illustrates the invention of FIG. 1 in side view with the joint in a 90 degree open position.

FIG. 5 depicts a side view of the support 8 with two pillows 1 & 7 with the joints 4*a* & 4*b* adjusted with their respective pairs of leaves 10*a* & 10*c* and 10*b* & 10*d* at 90 degrees. The frames 9*a* & 9*b* of leaves 10*a* & 10*b* have been extended following pressing of the buttons 6*a* & 6*b* of the actuators, sliding along their respective hinge leaves 10*a* & 10*b* so that a user can achieve any desired position between full extension or full retraction of the frames 9*a* & 9*b*.

Figure 6:
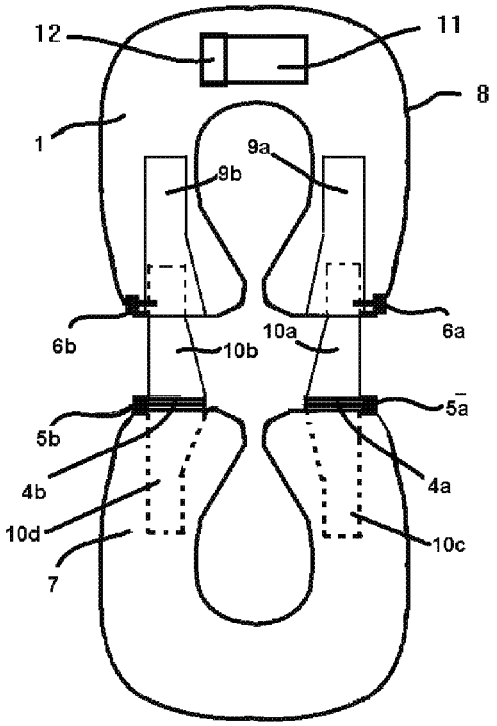
FIG. 6 illustrates the invention as depicted in FIG. 1 in front view with the joint in an open position and shows a storage compartment with a closed retaining flap.

FIG. 6 depicts a front view of the support 8 with the two pillows 1 & 7 and the pairs of joint leaves 10*a* & 10*c* and 10*b* & 10*d* adjusted to a straight angle of 180 degrees. This embodiment depicts the joint leaves 10*c* & 10*d* located fully inside the second pillow 7 while the leaves 10 & 10*b* are exposed with the frames 9*a* & 9*b* extended. Actuation of the knobs 5*a* & 5*b*, and buttons 6*a* & 6*b* is required to adjust the respective frames 9*a* & 9*b* and hinges 4*a* & 4*b* as previously described.

This embodiment of the support further depicts a storage space 11 with a closure 12. The storage space 11 may be used for any miscellaneous item however typically it is used for the storage of travel related items, headphones, ear plugs, eye mask, pen, batteries and the like.

Figure 7:
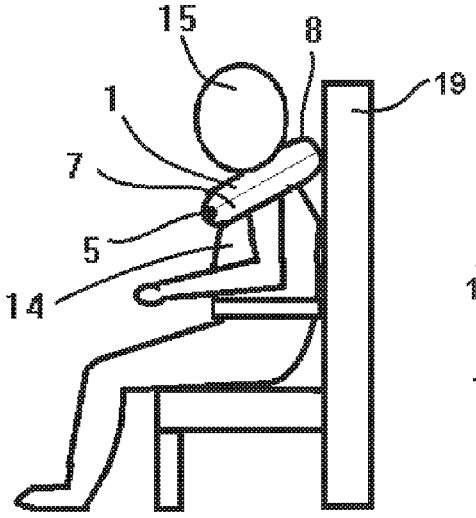
FIG. 7 illustrates the invention of FIG. 1 in side view with the joint in a closed position located around the neck of the seated traveler.
Figure 10:
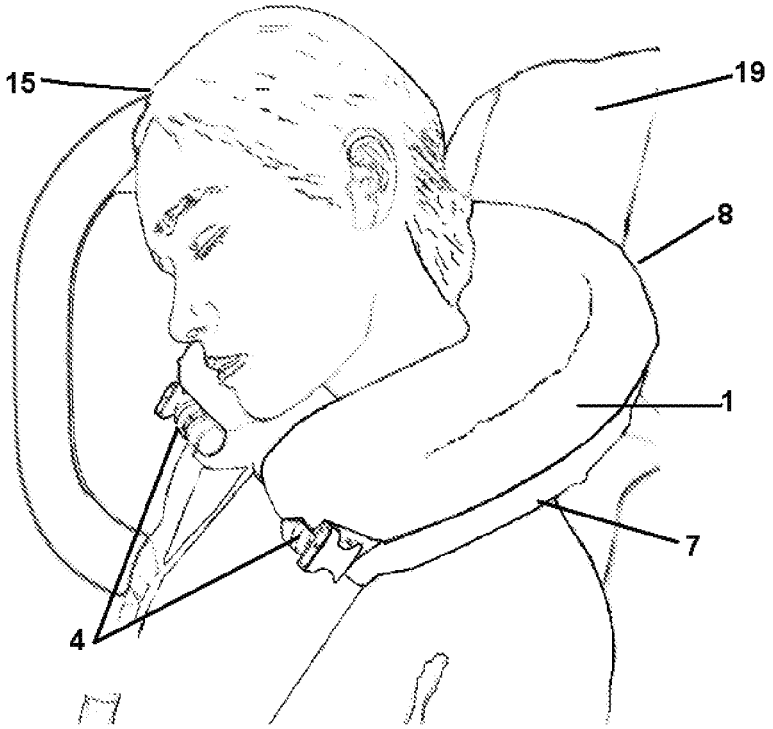
FIG. 10 is a perspective view of a first mode of use of the support of FIG. 1.

FIG. 7 depicts a side view and FIG. 10 is a perspective view of the first mode of use of the support 8. In the first mode the two pillows 1 & 7 are closed against each other with their inner surfaces (1*b*, 7*b*) pressed together. The support 8 is located around the neck of the seated user 14 in a position typical of a conventional U shaped travel pillow. The traveler 14 is able to shift their position to rest their head 15 against the support 8 or the seat 19. In this mode the user 14 does not have support for the head 15 if the weight of the head 15 shifts forward away from the seat 19 because the U-shaped opening 3 defined by the pillows 1 & 7 provides no support in that area.

Figure 11:
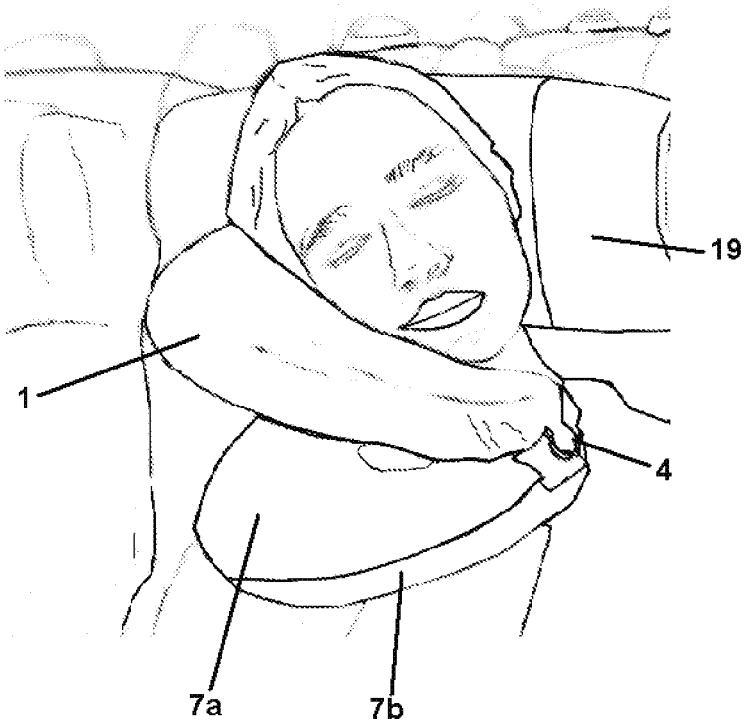
FIG. 11 is a perspective view of a second mode of use of the support of FIG. 1.

FIG. 11 depicts a second mode of use wherein the support 8 is more open with the joint 4 is locked to maintain an acute angle between the two pillows 1 & 7. The user can rotate the support around their neck to the desired position, resting the pillows on the seat.

Figure 12:
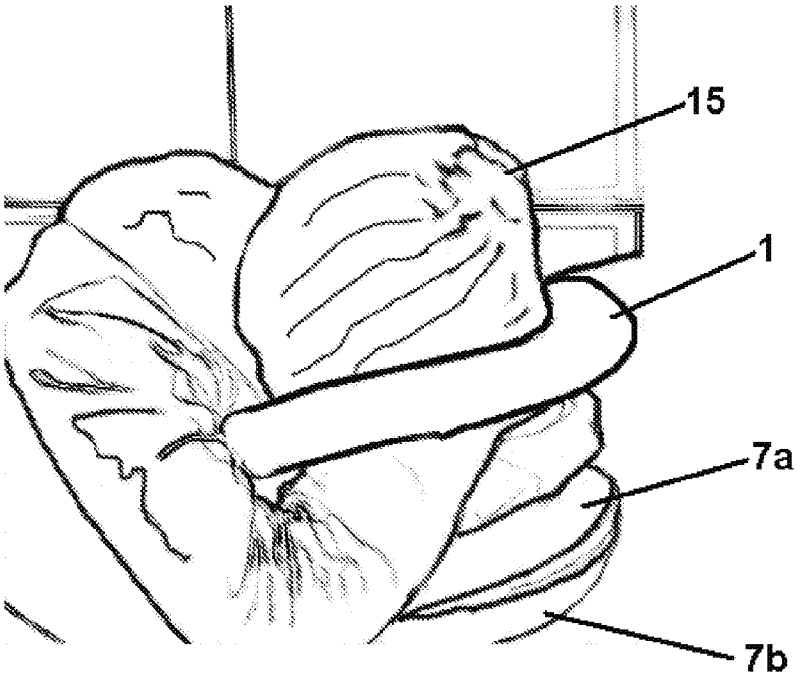
FIG. 12 is a perspective view of a third mode of use of the support of FIG. 1.

FIG. 12 depicts a third mode of use, the two pillows 1 & 7 are opened and the joint 4 is locked to form an acute angle about the joints 4*a* & 4*b*. The second pillow can be rested on a flat surface such as a bench or tray table extending from the rear of an aeroplane seat. Typically the user will place their forearms between the first and second pillow.

Figure 8:
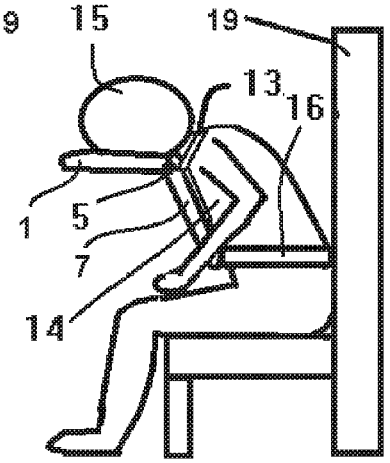
FIG. 8 illustrates the invention of FIG. 1 in side view with the joint in an open and angled position adjusted to support the head, neck and first body of a forward leaning, seated traveler and having an adjustable strap located around the traveler's neck.
Figure 13:
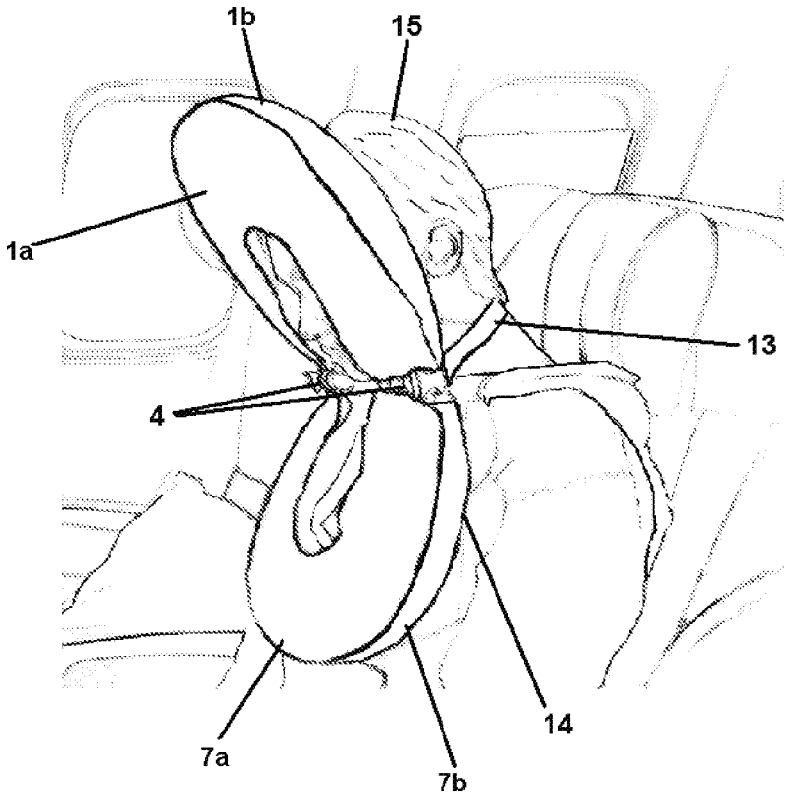
FIG. 13 is a perspective view of a fourth mode of use of the support of FIG. 1.

FIG. 8 depicts a fourth mode of operation of the support 8 in a side view. FIG. 13 is a perspective view of the fourth mode of operation of the support 8. In this mode the two pillows 1 & 7 are in an open position. In this mode the user has their head 15 against the outer surface 1*a* or the first pillow 1 and their chest against the outer surface of the second pillow 7. The weight of the travelers head, neck and upper body is downwardly pressing against the pillow 1 in which the frames 9*a*, 9*b* may optionally be extended from the joint leaves 10 (not visible) providing a comfortable sleeping or resting position. Extending the frames may be particularly desirable, for example, for very tall users. The weight is also transferred to the user's 14 chest and second body through the frames 9*a*, 9*b*. In this embodiment an adjustable strap 13 is located around the neck of the user 14 and attached adjacent the joints 4*a*, 4*b* of the support 8 thus preventing the support 8 from falling downward if the user 14 lifts their head 15 or shifts their body position. The support 8 may also be rested against the seat arm 16 or in further embodiments a secondary frame (not drawn) may extend from the support 8 to provide a further brace which may rest or be affixed to the seat arm 16, seat 9 or any other conveniently located fixed structure.

Figure 9:
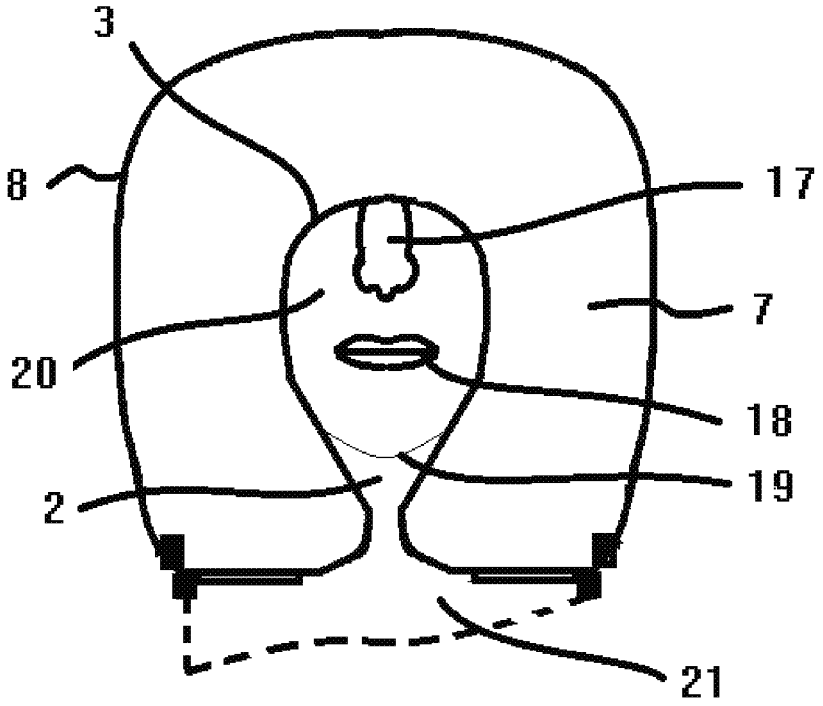
FIG. 9 illustrates the invention of FIG. 1 in front view with the traveler's nose and mouth exposed to enable unrestricted breathing.

FIG. 9 depicts a front partial view of the support 8 with the user's face 20 resting against the second pillow 7. In this embodiment the U-shape 3 defined by the pillows of the support 8 enables the weight of the user's head to be dispersed through the support 8 whilst the space 2 defined by the pillows leaves the face 20 unrestricted so the user can breathe through their nose 17 and mouth 18. In this view the support is only partially shown and the second half 21 of the support 8 has been omitted. The support 8 herein is positioned against the user in the same manner as described in FIG. 8 whereby the travelers said weight is dispersed to the traveler's chest and lower body.

Figure 14:
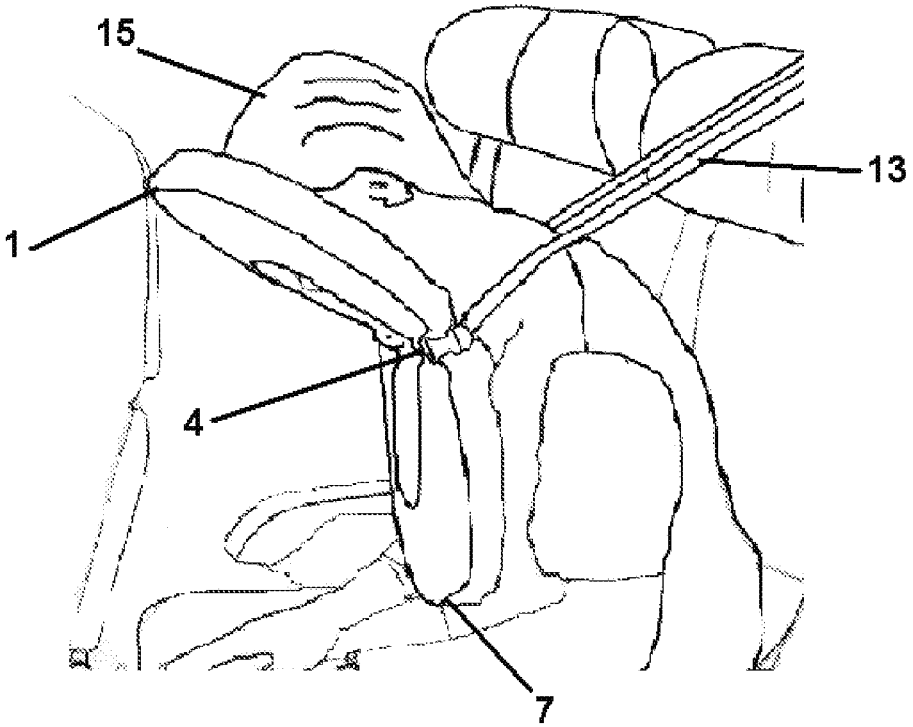
FIG. 14 is a perspective view of a fifth mode of use of the support of FIG. 1.

FIG. 14 depicts a fifth mode of use of the support 8 wherein the adjustable strap 13 is looped around a seat headrest or otherwise attached to the seat. The ends of the strap are attached adjacent the joints 4 of the support 8, again preventing the support 8 from falling downward if the user 14 lifts their head 15 or shifts their body position. In this mode the user rests their face in the U-shaped recess.

Figure 15:
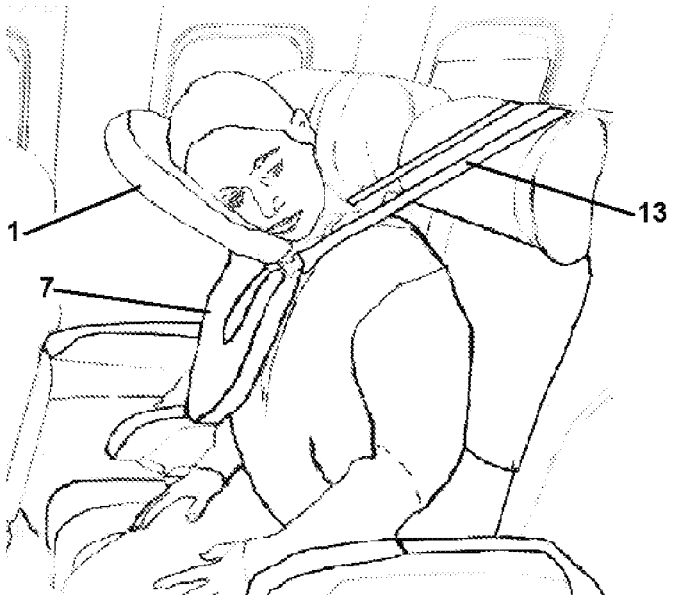
FIG. 15 is a perspective view of a sixth mode of use of the support of FIG. 1.

FIG. 15 depicts a sixth mode of use of the support 8, which is similar to the fifth mode, except that the user rests with one cheek on the first pillow.

The fifth and sixth modes allow the user to lean forward in a manner similar to propping their head with their hands. When used in aeroplanes, these modes provide the advantage that the person in front can angle their seat backwards without interfering with use of the support. Furthermore the user does not need to incline their own seat.

In a seventh mode the user loops the adjustable strap around a seat headrest, opens the pillows to form an obtuse angle at the joints and orients the support to their left or right side so the user sleeps upright with their back to the seat but with all their weight leaning sideways.

There are multiple other modes of use of the support of the present invention which will be readily apparent to the user and which will fall within the scope of the present application.

Figure 16:
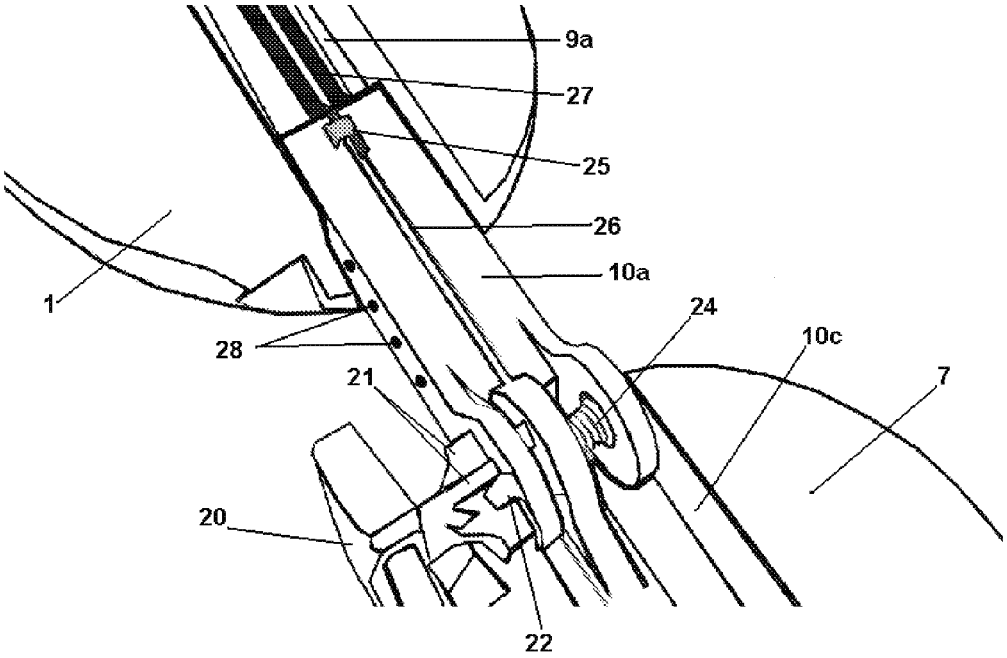
FIG. 16 is a perspective view of one embodiment of a joint suitable for use in the support of the present invention.

FIG. 16 depicts one embodiment of a joint according to the present invention. In this embodiment the joint can lengthen and shorten the distance between the pillows by virtue of a sliding ratchet mechanism which can be operated manually by pulling the pillows away or pushing the pillows toward each other. The ratchet comprises a tubular configuration of the leaf 10*a* which receives the frame 9*a*. The frame 9*a* has two integral legs sprung outwardly with a dome shaped end (not visible) that engages with the recesses 28 to lock the selected distance position.

Figure 17:
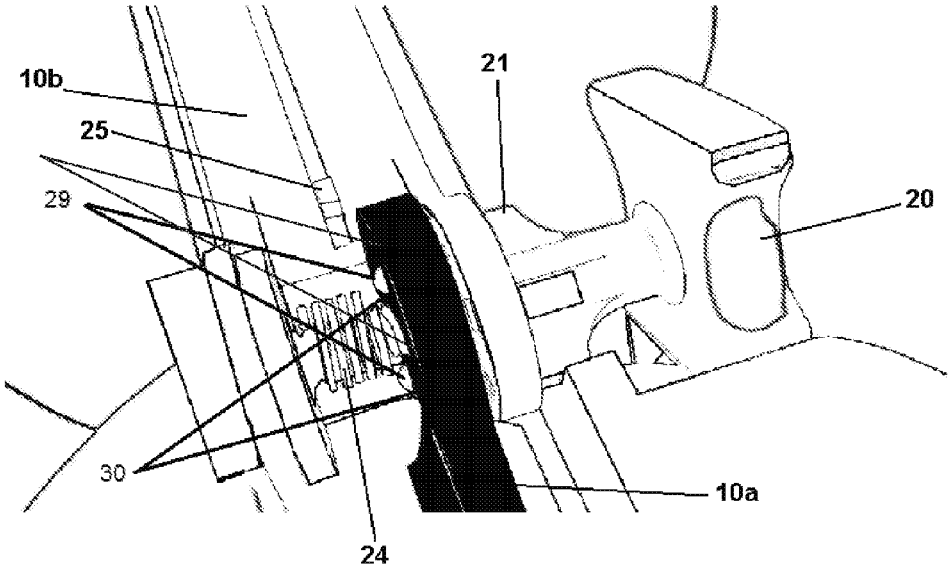
FIG. 17 shows the joint of FIG. 16 in greater detail.

Furthermore as depicted in FIG. 17 in this embodiment the joint can be rotated by depressing the knob 20 which is connected to a splined shaft 21 which slides through an orifice 22 drawn in FIG. 16 and pushes the frame 9*a* to disengage the pins 29 which slide into any of the multiple recesses 30 located in the frame 9*a*. When the knob 20 is released the spring 24 pushes the frame 9*a* toward the pin and as the joint is rotated the pins 29 slide back into the recesses 30 to lock the desired angle of the frames 9*a* and 9*b* relative to each other and thus setting the angle of the pillows 1 & 7.

It is also to be understood that the specific devices and modes illustrated in the attached drawing, and described in the specification are simply exemplary embodiments of the inventive concepts defined in the appended claims. Hence, specific dimensions and other physical characteristics relating to the embodiments disclosed herein are not to be considered as limiting, unless the claims expressly state otherwise. Additionally, unless otherwise specified, it is to be understood that discussion of a particular feature of component extending in or along a given direction or the like does not mean that the feature or component follows a straight line or axis in such a direction or that it only extends in such direction or on such a plane without other directional components or deviations, unless otherwise specified.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A support comprising:

a first generally u-shaped pillow having a first arm and a second arm extending from a first pillow body defining an opening, a second generally u-shaped pillow having a third arm and a fourth arm extending from a second pillow body defining an opening, the first and third arms being directly attached to a first hinge joint and the second and fourth arms being directly attached to a second hinge joint, wherein the first and second pillows have a substantially similar perimeter profile;

wherein the first and second pillows are configured to receive a portion of a user's neck between the first and second arms and the third and fourth arms such that the at least one of the first and second pillow bodies is configured to support a user's head; and wherein the first pillow has an upper surface and a bottom surface wherein the upper surface is curved, and the second pillow has an upper surface and a curved bottom surface, wherein the lower surface of the first pillow and the upper surface of the second pillow are configured to be substantially flush with each other when the first and second hinge joints are folded to a closed position.

2. The support according to claim 1, wherein the first and second pillows can be rotated about the hinge joints, and wherein the user's head can rest on the second pillow body.

3. The support according to claim 1 further comprising a releasable locking mechanism, wherein a degree of rotation of the first pillow and the second pillow about the hinge joint can be releasably maintained, wherein rotation of the releasable locking mechanism of the hinge joint in a first direction activates the locking mechanism, and wherein rotation of the releasable locking mechanism in a second direction reduces restriction on the hinge joint.

4. The support according to claim 1 further comprising a harness that can be located between the support and a seat occupied by the user such that, in use, the harness bears part of a user's weight.

5. The support according to claim 4, wherein the harness is a strap of adjustable length having ends removably attachable from the support, wherein attachment points of the removably attachable strap are adjacent to the first and second hinge joints, and wherein the removably attachable strap can be looped around the seat.

6. The support according to claim 1, wherein the support is portable, and wherein the second pillow is of a same shape and dimensions as the first pillow.

7. The support according to claim 1, wherein at least one of the first pillow and the second pillow is inflatable.

8. The support according to claim 1, wherein the first hinge joint and the second hinge joint are extendable.

9. The support according to claim 8 further comprising a releasable locking mechanism, wherein an amount of extension or retraction of the hinge joint can be releasably maintained.

10. The support according to claim 1, wherein the first hinge joint and the second hinge joint each comprises at least one extendable leaf attached to an extendable frame, and wherein the extendable frame is located inside at least one of the first and second pillows.

11. The support according to claim 1, wherein (i) a degree of rotation of the pillows around the hinge joints, and (ii) a separation between the pillows in a vicinity of the hinge joints can be varied.

12. The support according to claim 1, wherein at least one of the first and second pillows further comprises a storage space, and wherein the storage space has a closure.

13. The support according to claim 1, wherein at least one of the first and second pillows includes an internal rigid structural support.

14. The support according to claim 1, wherein the first pillow and the second pillow are integral and the first hinge joint and the second hinge joint are flex points, wherein a degree of rotation around the hinge joints can be adjusted and releasably locked using a locking mechanism.

15. A method of using a support, the support comprising:

a generally U-shaped first pillow having a first arm and a second arm extending from a first pillow body defining an opening, a generally U-shaped second pillow having a third arm and a fourth arm extending from a second pillow body defining an opening, the first and third arms being attached to an extendable first hinge joint, and the second and fourth arms being attached to an extendable second hinge joint, wherein the first and second pillows have a substantially similar perimeter profile and wherein the first pillow has an upper surface and a bottom surface wherein the upper surface is curved, and the second pillow has an upper surface and a curved bottom surface, wherein the lower surface of the first pillow and the upper surface of the second pillow are configured to be substantially flush with each other when the first and second extendable hinge joints are folded to a closed position;

wherein the method comprises the steps of:

(a) rotating the first and second pillows about the hinge joints, (b) optionally extending the first and second hinge joints, (c) locating the front of a user's neck between the first arm and the second arm such that the first pillow body is configured such that a user's head can rest in a forward position on the first pillow body, (d) locating the second pillow on a surface to support a weight of the user's head, and (e) receiving a portion of the user's neck between the first and second pillows.

16. The method according to claim 15 further comprising:

(f) connecting a harness between the support and the user or a structure to bear part of the weight.

17. The support according to claim 1, wherein the second and third arms form the second pillow body, and wherein the second and third arms are bilaterally symmetrical.

18. The support according to claim 1, wherein the first pillow is bilaterally symmetrical to the second pillow along a horizontal plane.

19. The method according to claim 15, further comprising depressing a knob connected to a splined shaft to disengage pins from at least one recess in a frame.

* * * * *